US008807077B2

(12) United States Patent
Meissner et al.

(10) Patent No.: US 8,807,077 B2
(45) Date of Patent: Aug. 19, 2014

(54) COATING DEVICE AND COATING METHOD HAVING A CONSTANT DIRECTING AIR TEMPERATURE

(75) Inventors: Alexander Meissner, Stuttgart (DE); Frank Herre, Oberriexingen (DE); Marcus Frey, Weil der Stadt (DE); Torsten Block, Nufringen (DE); Michael Baumann, Flein (DE)

(73) Assignee: Durr Systems GmbH, Bietigheim-Bissingen (DE)

( * ) Notice: Subject to any disclaimer, the term of this patent is extended or adjusted under 35 U.S.C. 154(b) by 1040 days.

(21) Appl. No.: 12/667,249

(22) PCT Filed: Jun. 20, 2008

(86) PCT No.: PCT/EP2008/005015

§ 371 (c)(1), (2), (4) Date: Mar. 14, 2011

(87) PCT Pub. No.: WO2009/003602

PCT Pub. Date: Jan. 8, 2009

(65) Prior Publication Data

US 2011/0159196 A1 Jun. 30, 2011

(30) Foreign Application Priority Data

Jul. 2, 2007 (DE) ..... 10 2007 030 724

(51) Int. Cl.

| | |
|---|---|
| ***B05C 11/10*** | (2006.01) |
| ***B05B 3/00*** | (2006.01) |
| ***B05B 3/10*** | (2006.01) |
| ***B05B 1/28*** | (2006.01) |

(52) U.S. Cl.

CPC ..... *B05B 3/1092* (2013.01); *B05B 3/001* (2013.01)

USPC ..... 118/666; 118/667; 118/712; 118/323; 118/63; 239/224; 239/290

(58) Field of Classification Search

CPC ..... B05C 11/10

USPC ..... 118/300, 666, 667, 712, 62, 63, 321, 118/323, 669–701; 239/290–301, 135

See application file for complete search history.

(56) References Cited

U.S. PATENT DOCUMENTS 4,108,241 A * 8/1978 Fortini et al. ..... 165/146
4,936,510 A * 6/1990 Weinstein ..... 239/223

(Continued)

FOREIGN PATENT DOCUMENTS

DE 10239517 A1 3/2004
EP 1688185 A1 8/2006

(Continued)

*Primary Examiner* — Yewebdar Tadesse

(74) *Attorney, Agent, or Firm* — Bejin VanOphem and Bieneman PLC

(57) ABSTRACT

Exemplary coating devices and methods are disclosed. An exemplary coating device may include an atomizer for applying a spray jet of a coating means or material to a component, at least one directing air nozzle for outputting shaping or directing air in order to shape the spray jet, and a temperature-control device for controlling the temperature of the directing air. The coating device may further include a control unit which activates the temperature-control device as a function of at least one operating variable of the atomizer in order to set a predetermined directing air temperature.

17 Claims, 2 Drawing Sheets

(56) References Cited

U.S. PATENT DOCUMENTS

| | | | | |
|---|---|---|---|---|
| 4,998,502 | A | 3/1991 | Schucker | |
| 6,534,127 | B2 * | 3/2003 | Ohmoto et al. | 427/407.1 |
| 6,972,052 | B2 | 12/2005 | Krumma et al. | |
| 2002/0082923 | A1 * | 6/2002 | Merriman et al. | 705/14 |
| 2005/0181142 | A1 * | 8/2005 | Hirano et al. | 427/421.1 |
| 2006/0175439 | A1 * | 8/2006 | Steur et al. | 239/703 |
| 2007/0262170 | A1 * | 11/2007 | Nolte et al. | 239/291 |
| 2008/0084141 | A1 * | 4/2008 | Schueren | 310/68 B |

FOREIGN PATENT DOCUMENTS

| | | | | |
|---|---|---|---|---|
| JP | 08108104 | * | 4/1996 | B05B 5/04 |
| JP | 08108104 | A | 4/1996 | |
| JP | 09225350 | A | 9/1997 | |
| JP | 2000325860 | A | 11/2000 | |
| JP | 2006-326460 | A | 12/2006 | |
| WO | WO-8800675 | A1 | 1/1988 | |
| WO | WO-2005110619 | A1 | 11/2005 | |

* cited by examiner

COATING DEVICE AND COATING METHOD HAVING A CONSTANT DIRECTING AIR TEMPERATURE

CROSS-REFERENCE TO RELATED APPLICATIONS

This application is a National Phase application claiming the benefit of International Application No. PCT/EP2008/005015, filed Jun. 20, 2008, which claims priority to German Patent Application No. DE 10 2007 030 724.3, filed Jul. 2, 2007, the complete disclosures of which are hereby incorporated by reference in their entireties.

BACKGROUND

The present disclosure relates to a coating device and a corresponding coating method, for example for the painting of motor vehicle body parts.

Rotary atomizers may generally be driven pneumatically by means of an air turbine and atomise the paint to be applied by means of a bell cup which is rotating at high speed, and are conventionally used for painting motor vehicle body parts or other components. It is furthermore known to form the spray jet applied by the bell cup by means of so-called shaping air. To this end, shaping air nozzles are attached in the rotary atomizer axially behind the bell cup, which output a shaping air jet essentially in the axial direction from behind onto the spray jet, so that the opening angle of the spray jet can be influenced by the shaping air jet.

What is problematic in the use of shaping air is the fact that the shaping air supplied under pressure cools down suddenly when leaving the shaping air nozzle, which can lead to the disruptive formation of condensation water.

To solve this problem, JP 08 108 104 A proposed to preheat the supplied shaping air by means of electric heating and temperature regulation to a certain temperature, so that the temperature drop of the shaping air when leaving the shaping air nozzles is no longer sufficient to cause the disruptive formation of condensation water.

In addition to the previously described rotary atomizers with a pneumatic drive by means of a air turbine, rotary atomizers are for example also known from WO 2005/110619 A1, in the case of which the bell cup is driven by an electric motor. Here, the shaping air can also be used for cooling the electric motor, in that the shaping air is conveyed through the stator of the electric motor and in this case absorbs part of the electric waste heat arising in the stator and dissipates it.

In the case of the known rotary atomizers, the shaping air is thermally influenced during the passage through the rotary atomizer, that is to say in dependence on the operating state of the rotary atomizer, so that the shaping air temperature at the outlet of the shaping air nozzle fluctuates in dependence on the operating state of the rotary atomizer, which has a negative effect on the painting process, as the applied paint arrives on the component to be painted dryer or wetter, depending on the fluctuation of the shaping air temperature.

Although a coating device with a temperature-control device and a control unit is known from DE 102 39 517 A1, the heating device in this case does not heat the shaping air, but rather the drive air which is used to drive the air turbine. Furthermore, it is only mentioned in general in this published document that shaping air can be heated in order to prevent a cooling down of the components due to the decompression of the drive air of the turbine.

Although EP 1 688 185 A1 discloses a coating device with a shaping air nozzle and a temperature-control device as well as a control unit, the control unit in this case has a completely different function, as the shaping air temperature is not kept constant in this case, but rather is varied in a targeted manner.

Finally, WO 88/00675 A1 only discloses a temperature-control device for flowable masses in general. A temperature control of the shaping air is not known from this citation, however.

Accordingly, known rotary atomizers fail to provide for targeted temperature control of shaping air, resulting in a degradation of painting quality associated with the known rotary atomizers and corresponding operating methods atomizer. Thus, there is a need for an improved atomizer and method of operating an atomizer that provides improved temperature control of shaping air.

DETAILED DESCRIPTION

Figure 1:
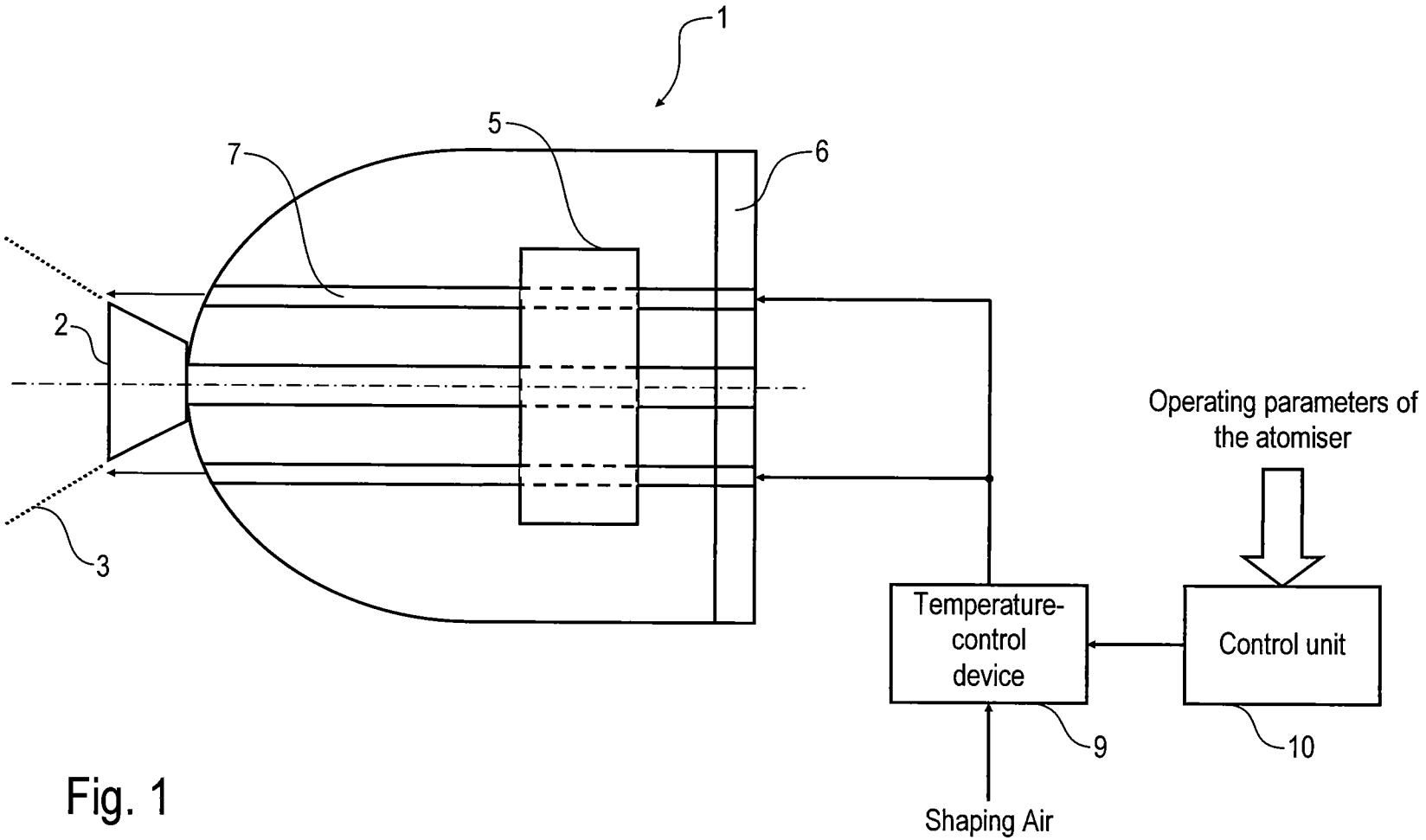
FIG. 1 shows a simplified schematic representation of an exemplary coating device including a rotary atomizer and a temperature-control device for controlling the temperature of the shaping air.

Various exemplary illustrations are disclosed herein, including a general technical teaching of keeping the shaping air temperature at the outlet of the shaping air nozzle constant independently of the operating state of the rotary atomizer, so that the painting quality is not impaired by fluctuations in the shaping air temperature, for example as may result from changes in an operating state of the rotary atomizer. For example, JP 08 108 104 A by contrast discloses keeping shaping air temperature upstream of the rotary atomizer constant, so that the thermal influencing of the shaping air temperature by the rotary atomizer is not taken into account, which leads to fluctuations in the shaping air temperature at the outlet of the shaping air nozzles.

An exemplary coating device includes an atomizer (e.g. a rotary atomizer) for the application of a spray jet of a coating means or material (e.g. wet paint) onto a component to be coated, such as for example a motor vehicle body part.

It is to be mentioned at this point that with respect to the atomizer type the exemplary illustrations are not limited to rotary atomizers. Rather, the principles disclosed herein may also be applied to other types of atomizers, such as for example airless atomizers, airmix atomizers, air atomizers or ultrasound atomizers, just to mention a few possible atomizer types.

Furthermore, with respect to the coating means, the exemplary illustrations are not limited to water-based paint, but can rather also be realised with other types of coating means, such as, merely as examples, solvent-based paints or powder-based paints.

Further, the exemplary illustrations are not limited to the coating of motor vehicle body parts, but rather can also be used for the coating of other components, such as for example for the coating of built-on parts or the like.

An exemplary coating device may further include at least one shaping air nozzle for discharging shaping air, in order to form the spray jet by means of the shaping air. The shaping air nozzle can be provided in any manner that is convenient, for example the shaping air nozzle may be integrated into the atomizer, or constructively separated from the atomizer.

An exemplary coating device may further include a temperature-control device in order to control the temperature of, that is to say to heat or to cool, the shaping air.

An exemplary coating device additionally may provides a control unit, which control unit controls the temperature-control device in dependence on at least one operating parameter (e.g. environmental temperature, volumetric flow of the shaping air) of the atomizer in order to set a predetermined, substantially constant shaping air temperature.

The term of a control unit or control, used in the context of the exemplary illustrations, may be understood in the narrower sense of regulation technology, according to which the shaping air temperature is set in a manner free of feedback as a controlled variable in dependence on the operating parameter of the atomizer which serves as a control variable. The term of a control unit or control, used in the context of the exemplary illustrations, is not limited to the previously mentioned understanding of the term in accordance with regulation technology, however, but rather also comprises controls with a precontrol or similar combinations of an open loop control and a closed loop control.

In the case of the temperature control of the shaping air, the current operating state of the atomizer is taken into account in order to compensate for the any thermal influencing of the shaping air by the atomizer.

This makes sense, because the shaping air in an exemplary illustration is conveyed at least to some extent by, adjacent, and/or through the atomizer to the shaping air nozzle, such that the atomizer thermally influences the shaping air in dependence on its operating state, for example by means of the electric waste heat of an electric drive motor or due to the decompression of the shaping air when exiting from the shaping air nozzle. When controlling the temperature-control device for the shaping air, the control unit therefore may observe one or more operating parameters of the atomizer which also determines the thermal influencing of the shaping air in the atomizer. For example, one potential operating parameter may be the driving power of an electric motor of the atomizer, as the driving power of the drive motor also determines, at least in part, the waste heat and thus any resulting heating of the shaping air.

In one exemplary illustration, a temperature-control device has a heating device which heats the shaping air with a settable heating power, for example as generally described in JP 08 108 104 A and therefore does not need to be described further.

Furthermore, the option exists in the context of the exemplary illustrations that a temperature-control device may include a cooling device which cools down the shaping air with a settable cooling power. The term of a temperature control, used in the context of the exemplary illustrations, therefore may include both a targeted heating of the shaping air and a targeted cooling down of the shaping air, in order to achieve a desired shaping air temperature which is as constant as possible at the outlet of the shaping air nozzle.

In one exemplary illustration, the atomizer is a rotary atomizer which has an air bearing which is provided with motor bearing air via a bearing air supply. In this example, the motor bearing air can also be used for cooling the shaping air, in that for example a part of the motor bearing air is mixed with the shaping air.

In another exemplary illustration, the cooling of the shaping air takes place by contrast by means of a separate coolant supply which supplies a gaseous or liquid coolant for cooling the shaping air.

Alternatively, in another example the cooling device has an electrothermal transducer, such as a Peltier element, for example.

The exemplary illustrations are therefore not limited to the previously described variants with regard to the functioning of the cooling device, but rather can also be realized in another manner.

It has already been mentioned that the atomizer can be a novel rotary atomizer, in the case of which the bell cup is not driven in the conventional manner by a pneumatic air turbine, but rather by an electric drive motor. In this case, the shaping air may be thermally coupled with the drive motor in order to cool the drive motor during operation by means of the shaping air. For example, thermal coupling between the shaping air and the drive motor can be achieved in that the shaping air is conveyed at least to some extent through the drive motor, for example as described in WO 2005/110619 A1 described above, so that the content of this patent application is expressly incorporated by reference its entirety within the present description.

In the case of the previously described cooling of the electric drive motor by the shaping air, the heating of the shaping air by means of the waste heat is innocuous, because this thermal influencing can be compensated for by means of the temperature-control device, so that the shaping air temperature is kept substantially constant independently of the driving power of the electric drive motor.

It is to be mentioned in this case that the temperature-control device can optionally control the temperature of the shaping air upstream of the drive motor or downstream of the drive motor.

Further, the coating device of the exemplary illustrations may advantageously have a heat conducting connection between the heat producing drive motor of the atomizer and the heat emitting external surface of the atomizer, wherein this heat conducting connection can. for example be effected by means of a conventional heat-conductive paste.

Furthermore, the possibility exists in the context of the exemplary illustrations that the control unit controls the temperature-control device in dependence on a measured environmental temperature, e.g., ambient temperature about the coating device and/or atomizer, in order to keep the shaping air temperature substantially constant, independently of fluctuations in the environmental temperature. The environmental temperature, which may be used as an input variable for the control, can in this case optionally be measured by a temperature sensor, modelled or predetermined in another manner.

In the case of the previously described example having an electric drive motor, the control unit may control the temperature-control device, e.g., in dependence on the driving power, in order to keep the shaping air temperature substantially constant independently of the current driving power and the waste heat in the drive motor connected with that. The driving power, which is used as the input variable for the control can in this case optionally be measured, modelled or predetermined for example by means of a motor control.

Further, the possibility exists in the context of the exemplary illustrations that the control unit may control the temperature-control device for the shaping air in dependence on a current volumetric flow of the shaping air, in order to achieve a substantially constant shaping air temperature independently of changes in the volumetric flow of the shaping air. The volumetric flow of the shaping air, which is used as the input variable for the control can for example be measured, modelled or predetermined in another manner. In one example, a volumetric flow sensor is provided, which measures the volumetric flow of the shaping air and supplies the measured value of the control unit as an input variable.

Further, the possibility exists in the context of the exemplary illustrations that the atomizer has at least one cooling body on its exterior, for example in the form of cooling ribs, in order to achieve thermal conditions in the atomizer which are as constant as possible.

In the case of this example, the cooling body may also be formed by the external surface of the atomizer, that is to say in the case of a rotary atomizer by means of the atomizer's lateral area. Even in this case, a heat-conductive paste can be used in order to achieve a thermal contact between the drive motor, which produces heat, and the cooling body.

It can already be seen from the above description that the exemplary illustrations are not only directed at a coating device, but also at a corresponding coating method.

Turning now to FIG. 1, an exemplary coating device with a rotary atomizer 1 is illustrated in a markedly simplified form, which rotary atomizer 1 can be used for painting motor vehicle body parts or other components.

The paint to be applied is atomized by a rotating bell cup 2 in this case and output in the form of a spray jet 3.

The bell cup 2 is in this case mounted on a rotatably mounted bell cup shaft 4, wherein the bell cup shaft 4 is driven by an electric motor 5 which is only represented schematically here.

Furthermore, the rotary atomizer 1 may form of the spray jet 3 by means of shaping air, wherein the shaping air is supplied to the rotary atomizer 1 by means of a connection flange 6.

In the rotary atomizer 1, the shaping air may be conveyed in shaping air lines 7 to shaping air nozzles 8 at the front end face of the rotary atomizer 1, where the shaping air is essentially directed axially from the rear onto the spray jet 3 of the paint to be applied, so that the opening angle of the spray jet 3 can be set by the discharge of the shaping air from the shaping air nozzles 8.

The shaping air line 7 in this case runs through the stator of the electric motor 5 in the rotary atomizer 1, so that the shaping air absorbs electric waste heat during the passage through the electric motor 5, which waste heat is created during operation in the electric motor 5, which contributes to the cooling of the electric motor 5.

The design and functioning of the rotary atomizer 1 may be of a similar construction as that described in the patent application WO 2005/110619 A1 cited at the beginning, therefore the content of this patent application is hereby expressly incorporated by reference in its entirety in the present description.

Furthermore, it is to be mentioned that the shaping air experiences a sharp temperature drop when leaving the shaping air nozzles 8 on account of the throttling, wherein this temperature drop depends upon, among other things, on the volumetric flow of the shaping air applied and can therefore fluctuate during operation of the rotary atomizer 1.

On the one hand, the shaping air temperature therefore fluctuates in dependence on the electric waste heat which the shaping air absorbs during the passage through the electric motor 5 from the electric motor 5, wherein the heating of the shaping air by the electric motor 5 is dependent on the current driving power of the electric motor 5.

On the other hand, the shaping air temperature also fluctuates in accordance with the temperature drop when leaving the shaping air nozzles 8 in dependence on the volumetric flow of the shaping air.

These fluctuations of the shaping air temperature cannot be compensated for by an input-side temperature regulation of the supplied shaping air, for example as described in JP 08 108 104 A.

The exemplary coating devices and methods therefore generally provide that the temperature control of the shaping air supplied to the rotary atomizer 1 in dependence on the current operating state of the rotary atomizer 1 is controlled in such a manner that the shaping air temperature maintains a predetermined constant value $T_{SET}$ after exiting the shaping air nozzles 8. This is advantageous, because the quality of the painting process is then not impaired by fluctuations in the shaping air temperature that would otherwise occur due to variations in the operating state of the rotary atomizer 1.

The exemplary coating device may additionally include a temperature-control device 9, which can heat and/or cool down the shaping air supplied to the rotary atomizer 1, in order to achieve the maintenance by the shaping air at the outlet of the shaping air nozzles 8 of the predetermined setpoint value $T_{SET}$ independently of the operating state of the rotary atomizer 1 and the heating or cooling down of the shaping air in the rotary atomizer 1 connected with that.

The temperature-control device may, as shown, be controlled by a control unit 10, wherein the control unit 10 sets a heating power or cooling power of the temperature-control device 9 in dependence on one or more operating parameters of the rotary atomizer 1 in such a manner that the shaping air temperature at the outlet of the shaping air nozzles 8 maintains the predetermined setpoint value $T_{SET}$.

In the event that, for example, the driving power of the electric motor 5 is increased, then the waste heat which is generated in the electric motor 5 also increases and leads to the heating of the shaping air. The control unit 10 then controls the temperature-control device 9 in such a manner that the heating power of the temperature-control device 9 is decreased or the cooling power of the temperature-control device 9 is increased, in order to compensate for the increased heat input due to the electric motor 5.

Figure 2:
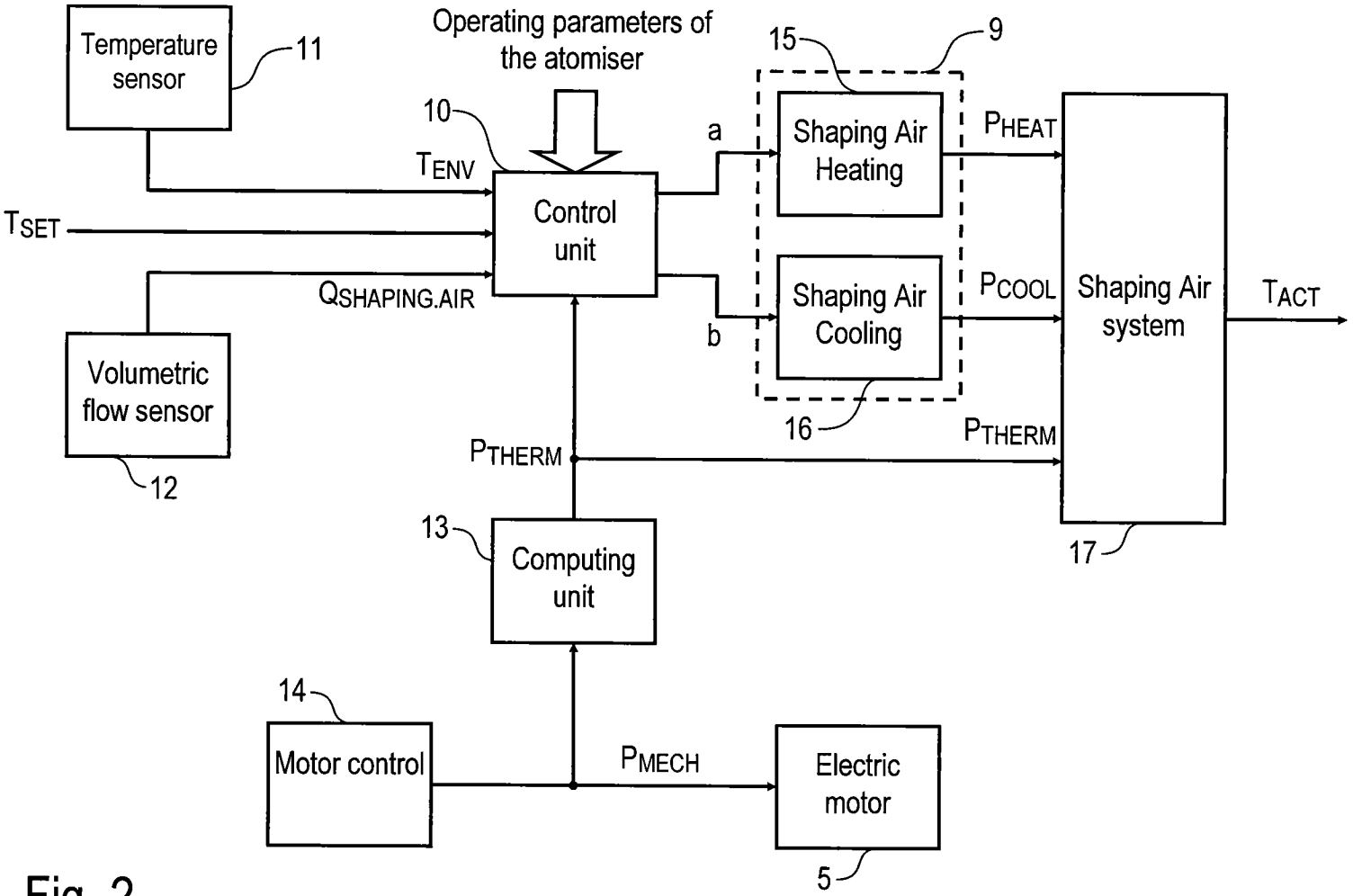
FIG. 2 shows an equivalent circuit diagram according to regulation technology of the coating device from FIG. 1.

In the following, the equivalent circuit diagram according to regulation technology of the exemplary coating device shown in FIG. 2 is described.

On the one hand it can be recognised from there that the control unit 10 may be connected at an inlet side to a temperature sensor 11, which measures an environmental temperature $T_{ENV}$, e.g., an ambient temperature about the coating device and/or atomizer, thereby allowing the control unit 10 to control the temperature-control device 9 in dependence, at least in part, on the measured environmental temperature $T_{ENV}$.

Furthermore, the control unit 10 may also be connected to a volumetric flow sensor 12 at the inlet side, which measures the overall volumetric flow $Q_{SHAPING.AIR}$ of the applied shaping air, wherein the control unit 10 also controls the temperature-control device 9 in dependence, at least in part, on the measured volumetric flow $Q_{DIREECT.AIR}$.

Instead of the previously described provision of the volumetric flow $Q_{SHAPING.AIR}$ by the volumetric flow sensor 12, the option alternatively exists that the volumetric flow $Q_{SHAPING.AIR}$ may be provided by a volumetric flow regulator, wherein the volumetric flow regulator adjusts the volumetric flow $Q_{SHAPING.AIR}$ to a predetermined setpoint value.

Furthermore, the control unit 10 may receive the setpoint value $T_{SET}$ for the desired shaping air temperature at the inlet side, wherein the control unit 10 also controls the temperature-control device 9 in dependence on this setpoint value $T_{SET}$.

Further, the control unit 10 can also take yet further operating parameters of the rotary atomizer 1 into account during the control of the temperature-control device 9, as is only schematically indicated here by a block arrow.

For example, the control unit 10 may take account of a thermal power loss $P_{THERM}$, which the electric motor 5 generates in the rotary atomizer 1, during the control of the temperature-control device 9, as the thermal power loss $P_{THERM}$ contributes to the heating of the shaping air in the rotary atomizer 1 and therefore may be compensated for in the context of the temperature control.

The thermal power loss $P_{THERM}$ is, in this example, calculated by a computing unit 13 from the mechanical driving power $P_{MECH}$, which is predetermined by a motor control 14.

The temperature-control device 9, in this example, includes a heating device 15 and a cooling device 16, wherein the heating device 15 heats the shaping air with a settable heating power $P_{HEAT}$, while the cooling device 16 can cool down the shaping air with a settable cooling power $P_{COOL}$.

To set the heating power $P_{HEAT}$ the control device 10 may generally control the heating device 15 with a corresponding control signal a. In the same manner, the control unit 10 may generally control the cooling unit 16 with a corresponding control signal b, in order to set the cooling power $P_{COOL}$.

Furthermore, a shaping air system 17 is shown in this illustration, which reproduces the thermal behavior of the shaping air in the sense of regulation technology and is influenced by the heating power $P_{HEAT}$, the cooling power $P_{COOL}$ and the thermal power loss $P_{THERM}$. The control unit 10 may then set the heating power $P_{HEAT}$ and the cooling power $P_{COOL}$ in such a manner that the actual value $T_{ACT}$ of the shaping air assumes the desired setpoint value $T_{SET}$, independently of the current operating state of the rotary atomizer 1.

The temperature control according to the exemplary illustrations is advantageous because, as a result, fluctuations in the shaping air temperature during the operation of the rotary atomizer 1 can be prevented, which contributes to a constantly good painting result.

The exemplary illustrations are not limited to the specific examples described above. Rather, a plurality of variants and modifications are possible, which likewise make use of the concepts of the exemplary illustrations and therefore fall under the scope of protection. Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be evident upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "the," etc. should be read to recite one or more of the indicated elements unless a claim recites an explicit limitation to the contrary.

The invention claimed is:

1. A coating device, comprising:

an atomizer configured to apply a spray jet of a coating material onto a component, at least one shaping air nozzle configured to discharge shaping air, thereby shaping the spray jet, a temperature-control device configured to control the temperature of the shaping air, and a control unit, configured to control the temperature-control device according to at least one operating parameter of the atomizer, in order to set a predetermined shaping air temperature of the shaping air, the at least one operating parameter including at least a mechanical driving power of an electric drive motor of the atomizer.

2. The coating device according to claim 1, wherein the shaping air is guided at least partially through the atomizer to the at least one shaping air nozzle, wherein the atomizer thermally influences the shaping air in dependence on an operating state associated with the atomizer, and the operating parameter of the atomizer used as an input variable for the control unit determines at least in part the thermal influencing of the shaping air in the atomizer.

3. The coating device according to claim 1, wherein the temperature-control device includes a heating device configured to heat the shaping air with an adjustable heating power.

4. The coating device according to claim 1, wherein the temperature-control device includes a cooling device configured to cool down the shaping air with a adjustable cooling power.

5. The coating device according to claim 4, wherein the atomizer is a rotary atomizer including an air bearing, the air bearing provided with motor bearing air via a bearing air supply, and the cooling device cools the shaping air with the motor bearing air.

6. The coating device according to claim 4, wherein the cooling device has a coolant supply, using which a coolant is supplied in order to cool the shaping air.

7. The coating device according to claim 1, wherein the drive motor is cooled during operation with the shaping air.

8. The coating device according to claim 7, wherein the shaping air is guided at least to some extent through the drive motor in order to achieve thermal coupling between the shaping air and the drive motor.

9. The coating device according to claim 7 wherein the temperature-control device controls the temperature of the shaping air at a position located one of upstream and downstream of the drive motor.

10. The coating device according to claim 1 further comprising a heat conducting connection between a heat producing drive motor of the atomizer and a heat emitting external surface of the atomizer.

11. The coating device according to claim 10, wherein the heat conducting connection includes a heat-conductive paste.

12. The coating device according to claim 1, further comprising a temperature sensor configured to measure an environmental temperature, wherein the temperature sensor is in communication with the control unit at an output side of the control unit, and the control unit controls the temperature-control device according to at least the measured environmental temperature.

13. The coating device according to claim 1, wherein the at least one operating parameter includes an adjustable volumetric flow of the shaping air.

14. The coating device according to claim 13, further comprising a volumetric flow sensor for measuring the volumetric flow of the shaping air, wherein the volumetric flow sensor is connected to the control unit at the output side.

15. The coating device according to claim 1, wherein the control unit controls the temperature-control device in a manner free of feedback.

16. The coating device according to claim 1, wherein the atomizer includes at least one cooling body on its exterior, the at least one cooling body include at least one cooling rib.

17. The coating device according to claim 1, wherein the at least one operating parameter includes at least one of a volumetric flow of the shaping air, a mass flow of the shaping air, and an environmental temperature.

* * * * *